US007855641B1

(12) United States Patent
Okafo

(10) Patent No.: US 7,855,641 B1
(45) Date of Patent: Dec. 21, 2010

(54) WINDOW FAN SECURITY SYSTEM

(76) Inventor: Nelson Chinedu Okafo, 1423 E. Main St., Columbus, OH (US) 43205

( * ) Notice: Subject to any disclaimer, the term of this patent is extended or adjusted under 35 U.S.C. 154(b) by 315 days.

(21) Appl. No.: 12/186,626

(22) Filed: Aug. 6, 2008

Related U.S. Application Data

(60) Provisional application No. 60/993,077, filed on Sep. 10, 2007, provisional application No. 61/017,502, filed on Dec. 28, 2007.

(51) Int. Cl.
*G08B 13/08* (2006.01)

(52) U.S. Cl. ..... 340/545.8; 340/545.1; 340/545.7; 340/545.9; 340/540

(58) Field of Classification Search ..... 340/545.1, 340/545.7, 545.8, 545.9, 540, 568.2, 573.1, 340/693.1
See application file for complete search history.

(56) References Cited

U.S. PATENT DOCUMENTS 4,288,867 A * 9/1981 Guthart ..... 367/93
6,107,930 A * 8/2000 Behlke et al. ..... 340/825.19

* cited by examiner

*Primary Examiner*—Hung T. Nguyen

(57) ABSTRACT

A window fan security system comprises a window fan housing, fan assembly, motion detector, audible alarm, light, and control panel, whereby the system is placed in a window, and when motion is detected proximate to the exterior of the window an alarm and/or light is triggered, whereby a would-be intruder is detected and deterred.

13 Claims, 3 Drawing Sheets

WINDOW FAN SECURITY SYSTEM

The present application is related to the co-pending provisional patent applications No. 60/993,077 of Nelson Chinedu Okafo, filed Sep. 10, 2007, entitled "Alarmed Window Fan", and No. 61/017,502 of Nelson Chinedu Okafo, filed Dec. 28, 2007, entitled "Window Fan Security System", and based on which priority is herewith claimed under 35 U.S.C. 119(e) and the disclosure of which is incorporated herein by reference in its entirety as if fully rewritten herein.

BACKGROUND AND SUMMARY

The present invention relates generally to theft or intrusion detection security systems and specifically to security systems applied in window fans.

Window fans are generally known in the art for providing airflow ventilation and exhaust of an interior space. Generally, operation thereof consists of placing them in an open window and closing the window onto the fan housing to hold the unit in place. However, such window fans create a security problem by facilitating unwanted intrusion or break-ins through the open window when the window cannot be easily locked after the fan is placed therein.

The present invention overcomes these as well as other problems that will be apparent to those of skill in the art by providing a security system applied to the window fan. The present invention generally comprises a window fan that is equipped with various features to monitor, detect, and alarm in the case of an intrusion or break-in.

REFERENCE NUMERALS IN DRAWINGS

Figure 1:
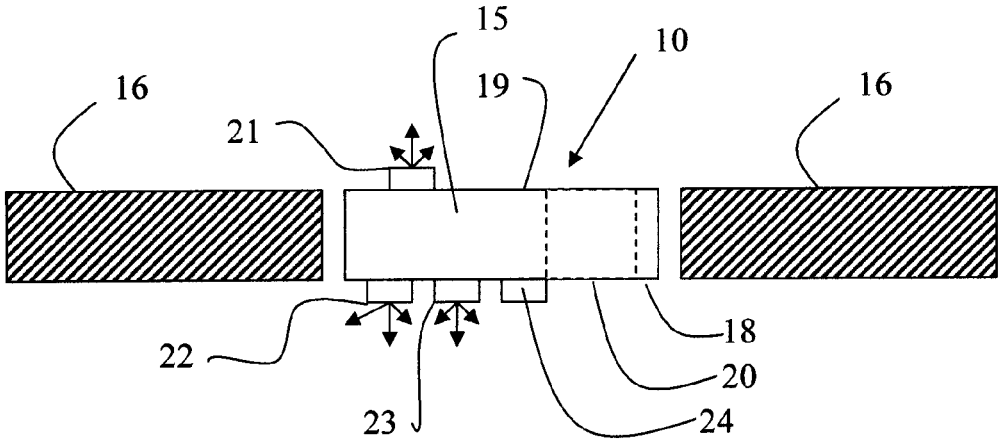
FIG. 1 depicts the top view of one embodiment of the window fan security system.

The table below lists the reference numerals employed in the figures, and identifies the element designated by each numeral.

10 Window fan security system 10
15 Window fan housing 15
16 Wall 16
17 Window 17
18 Interior facing side 18
19 Exterior facing side 19
20 Fan assembly 20
21 Motion detector 21
22 Audible Alarm 22
23 Light 23
24 Control panel 24
25*a* Fan controls 25*a*
25*b* Motion detector controls 25*b*
25*c* Alarm controls 25*c*
25*d* Light controls 25*d*
30 Power supply 30

DETAILED DESCRIPTION

Figure 2:
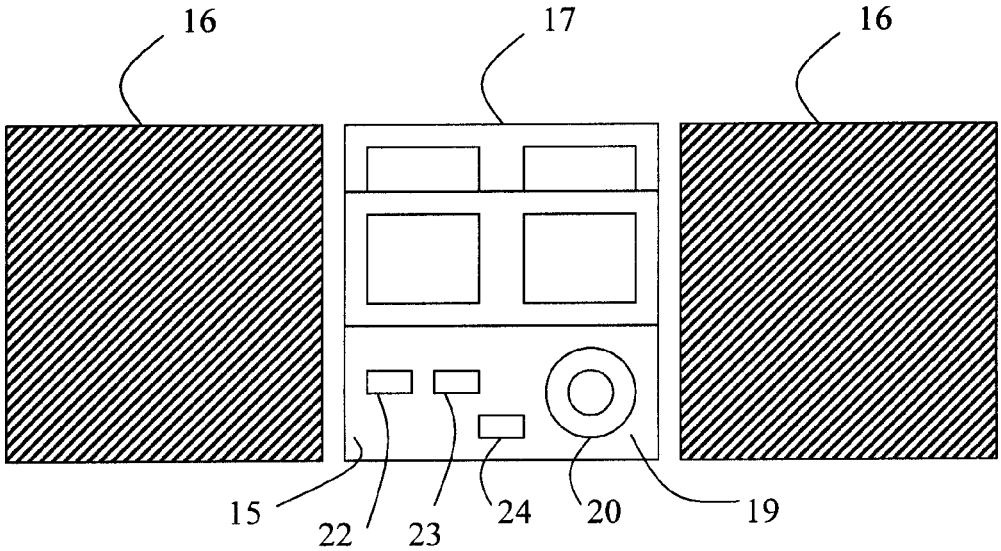
FIG. 2 depicts the interior front view of one embodiment of the window fan security system.
Figure 4:
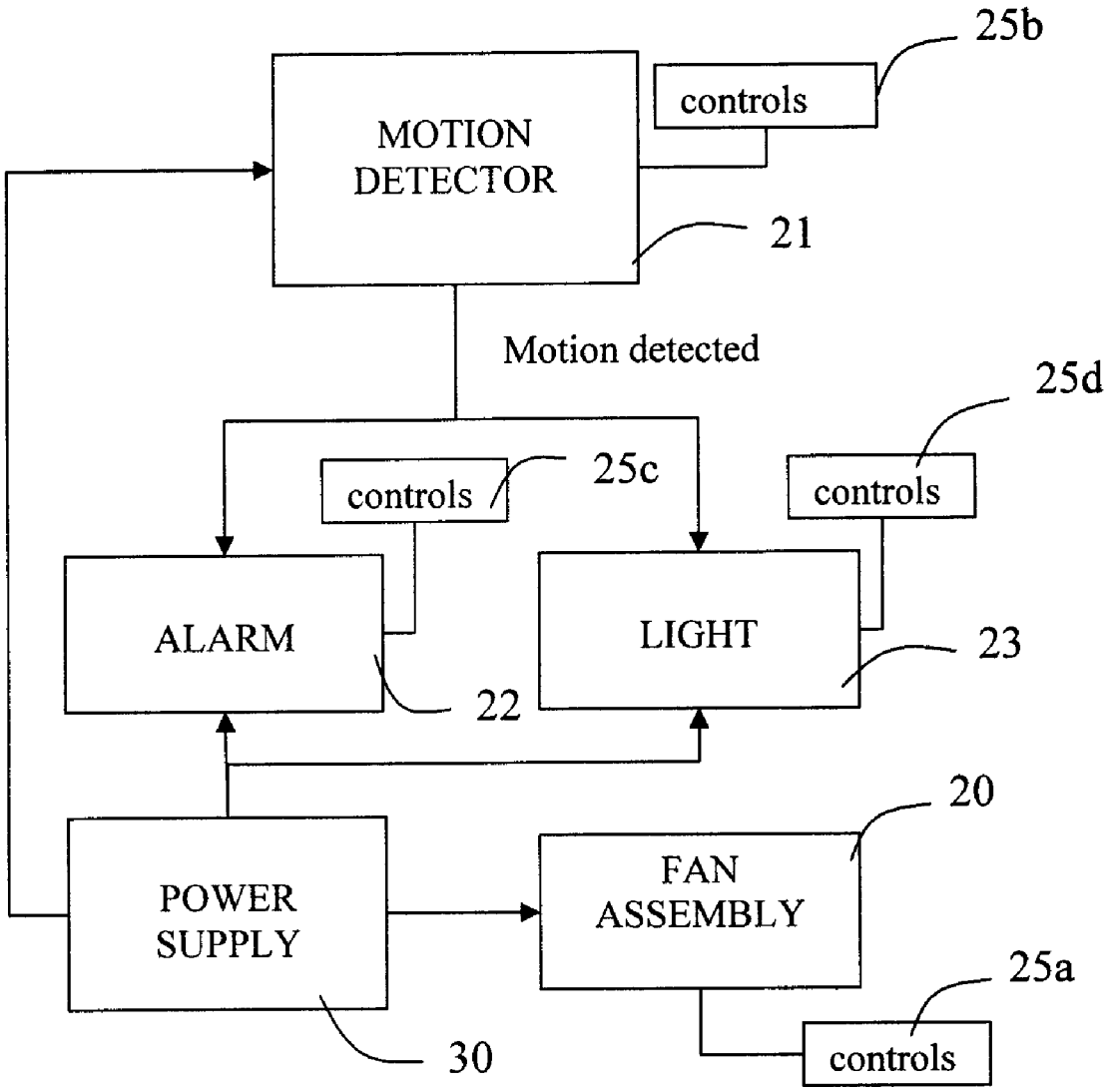
FIG. 4 depicts a block diagram of the components of one embodiment of the window fan security system.

One embodiment of the window fan security system 10 as shown in FIGS. 1 and 2 comprises window fan housing 15, fan assembly 20, motion detector 21, audible alarm 22, light 23, and control panel 24. FIG. 4 block diagram also shows the hidden components of fan assembly controls 25*a*, motion detector controls, 25*b*, alarm controls 25*c*, light controls 25*d*, and power supply 30. It is to be understood that "audible alarm" as used herein, may at times be generally described as "alarm".

Figure 3:
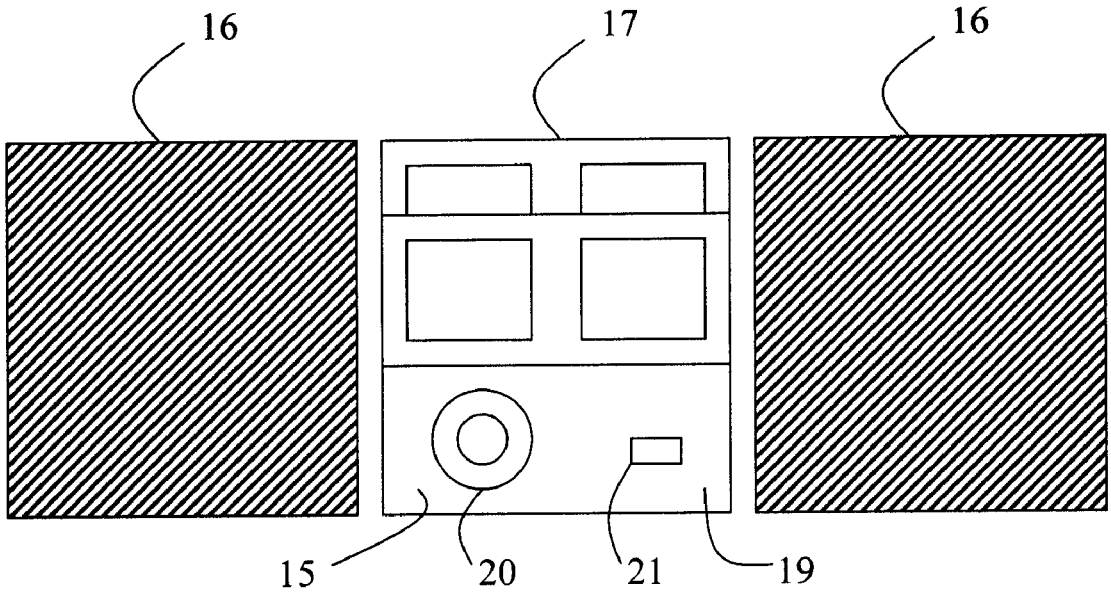
FIG. 3 depicts the exterior back view of one embodiment of the window fan security system.

Window fan security system 10 is positioned inside open window 17, with walls 16 on either side. Preferably, when armed by the user, motion detector 21, located on exterior facing side 19 of window fan housing 15, (see FIGS. 1 and 3), triggers alarm 22 and light 23, located on interior facing side 18 of window fan housing 15. An alternative embodiment comprises the alarm and/or light being externally mounted.

Fan assembly 20 comprises a common household fan (e.g. with fan wheel, fan guard, and motor). Window fan housing 15 can be made of metal, plastic, or other durable material, and is preferably a square or rectangular box-type shape. Fan assembly 20 can be independently controlled for use as a stand-alone fan with the security system disabled, or unarmed.

Motion detector 21 preferably utilizes ultrasound, but can also use infra-red, lasers, or any other technology that allows the detection of motion. The pattern and direction of the detection beam can be adjusted in order to compensate for varying geographic conditions and preferences. Motion detector 21 is intended to monitor the area to the exterior of the window in which the fan is mounted so as to detect a would-be intruder approaching the window.

Alarm 22 comprises a common audible alarm, preferably with an adjustable sound level. Light 23 can be of various types (e.g. halogen, incandescent, LED, fluorescent) and can be adjusted for different levels of illumination. One of skill in the art will appreciate that myriad alarms and lights can be utilized.

The lighting is employed to preferably provide illumination to the interior of the room in which the fan is positioned once motion is detected by motion detector 21. This allows an occupant to navigate through the room as well as to notify a would-be intruder of the detection of their presence. The intruder would see the room suddenly lighted and would be deterred. Alarm 22 and/or light 23 can be selectively disabled. Preferably, at least one or the other would be used to allow the detection event to be perceived by the user. However, as will be apparent to those of skill in the art, either the light or alarm can be omitted.

FIGS. 1 and 2 indicate control panel 24, located on interior facing side 18 of fan housing 15. Control panel 24 provides a means for the user to manually or remotely interface the controls for each component of the system. Control panel 24 houses fan assembly controls 25*a*, motion detector controls 25*b*, alarm controls 25*c*, and light controls 25*d* (not shown). Block diagram FIG. 4 shows the system components, and the four independent controls of fan, motion detector, alarm, and light. It also indicates power supply 30, which powers all system components.

Power supply 30 can provide AC or DC power to run the system. The means of power supply preferably utilizes line voltage through an electrical cord plugged into a wall outlet, but could alternately be provided by battery, or by other suitable means. Power supply 30 provides power to run fan assembly 20, motion detector 21, alarm 22, and light 23. Power supply 30 can also provide line voltage or low voltage power (not shown) to allow actuation of controls 25*a*, 25*b*, 25*c*, and 25*d*.

Motion detector 21 actuates alarm 22 and/or light 23.

Another embodiment of the invention comprises, in addition to the foregoing embodiment, an automated controller for controlling fan assembly 20, motion detector 21, alarm 22, and light 23, preferably by a computer processor.

Although the description above contains many specificities, these should not be construed as limiting the scope of the embodiment, but merely as providing illustrations of some of the presently preferred embodiments. Thus, the scope of the embodiment should be determined by the appended claims and their legal equivalents, rather than by the examples given.

What is claimed is:

1. A window fan security system comprising:

a window fan housing including interior and exterior sides;

a fan assembly, motion detector, audible alarm, and light, all being in electrical communication with a power supply and a control panel, all being contained within said window fan housing;

whereby said window fan housing can be installed in a window;

further whereby said alarm and light are actuated by said motion detector.

2. The security system of claim 1 wherein either of said alarm or light are mounted on said interior side.

3. The security system of claim 2 further comprising at least one of an additional alarm or light mounted on said exterior side.

4. The security system of claim 1 wherein either of said alarm or and/or light are mounted on said exterior side.

5. The security system of claim 1 wherein said power supply is energized by line voltage.

6. The security system of claim 1 wherein said power supply comprises a battery system.

7. The security system of claim 1 wherein said motion detector utilizes ultrasound means.

8. The security system of claim 1 wherein said motion detector utilizes infra red means.

9. The security system of claim 1 wherein said control panel is manually operated.

10. The security system of claim 1 wherein said control panel is remotely operated.

11. The security system of claim 1 wherein said control panel comprises manually adjustable controls for said fan, motion detector, alarm and light.

12. The security system of claim 1 wherein said control panel further comprises an automated controller.

13. The security system of claim 12 wherein said automated controller comprises a computer processor.

* * * * *